US005682760A

United States Patent [19]

Hollingsworth

[11] Patent Number: 5,682,760

[45] **Date of Patent: *Nov. 4, 1997**

[54] APPARATUS AND METHOD FOR THE GENERATION OF HEAT FROM THE COMBUSTION OF WASTE OIL

[75] Inventor: Bruce Hollingsworth, Montreal, Mo.

[73] Assignee: Earth Partners, Inc., Montreal, Mo.

[ * ] Notice: The term of this patent shall not extend beyond the expiration date of Pat. No. 5,524,454.

[21] Appl. No.: 604,030

[22] Filed: Feb. 20, 1996

Related U.S. Application Data

[63] Continuation-in-part of Ser. No. 291,958, Aug. 17, 1994, Pat. No. 5,524,454.

[51] Int. Cl.[6] ..... F25B 15/00; F25B 27/00

[52] U.S. Cl. ..... 62/4.97; 62/238.3; 237/15 L; 165/48.1; 165/58

[58] Field of Search ..... 62/324.2, 238.3, 62/476, 497; 237/81, 15 L; 165/48.1, 58

[56] References Cited

U.S. PATENT DOCUMENTS

| | | | |
|---|---|---|---|
| 2,350,115 | 5/1944 | Katzow . | |
| 2,659,214 | 11/1953 | Coggburn | 62/238.3 |
| 3,541,013 | 11/1970 | Macriss et al. . | |
| 3,609,086 | 9/1971 | Modahl . | |
| 4,055,964 | 11/1977 | Swenson et al. . | |
| 4,070,870 | 1/1978 | Bahel et al. | 62/2 |
| 4,312,476 | 1/1982 | Pohlmann | 62/324.2 |
| 4,523,631 | 6/1985 | McKinney | 165/43 |
| 5,524,454 | 6/1996 | Hollingsworth | 62/497 |

*Primary Examiner*—William Doerrler

*Attorney, Agent, or Firm*—Hovey, Williams, Timmons & Collins

[57] ABSTRACT

An apparatus and method is provided for the generation of heat from the combustion of waste oil. The apparatus includes the waste oil burner and novel combustion chamber operative to generate heat from the combustion of waste oil, a storage tank for containing heat transferring fluid, an absorbtion type chilling unit, a heating unit, or both, and heat transfer fluid pumps, piping, valves, and a control system for transferring the heat transfer fluid, and the heat it contains from the combustion chamber to the storage tank and ultimately to the heating unit or chilling unit.

12 Claims, 4 Drawing Sheets

APPARATUS AND METHOD FOR THE GENERATION OF HEAT FROM THE COMBUSTION OF WASTE OIL

RELATED APPLICATION

This is a continuation-in-part of application Ser. No. 08/291,958, filed Jul. 17, 1994, entitled Waste Oil Fired Air Conditioning Apparatus now U.S. Pat. No. 5,524,454. The teachings of application Ser. No. 08/291,958 are incorporated herein by reference.

FIELD OF THE INVENTION

The present invention relates to an apparatus and method for the generation of heat from the combustion of waste oil. More particularly, the present invention relates to such an apparatus and method which may be employed as a source of heat in absorption air conditioning and refrigeration devices, and also as a source of heat for space heaters.

BACKGROUND

Costs associated with heating and cooling of residential and commercial spaces, and with the operation of refrigeration equipment, typically represent a significant portion of total operating expenses. Further, such costs can become substantial in geographic regions which experience very high or very low temperatures during summer and winter seasons. Heating and cooling costs are, in large part, attributable to the cost associated with purchasing energy in such forms as electric power, natural gas and LP gas.

In the past, waste oil, although in plentiful supply from sources such as engine oil changes, have not been considered to be a viable energy source for heating and cooling. Conventional heat exchangers employed for the transfer of heat from a waste oil burner to another location are often inadequate to handle the generation of soot and ash associated with the combustion of visious waste oil. As a result, conventional heat exchangers are quickly fouled and suffer an attendant reduction in heat transfer capability.

Further, the highly acidic and corrosive effects of soot and ash byproducts preclude the use of waste oil burners in certain contexts. In particular, heat transfers surfaces in direct contact with a waste oil flames are not typically designed for the highly corrosive environment created by waste oil byproducts.

The following U.S. patents are illustrative of the state of the art in the field of the invention: U.S. Pat. No. 2,350,115 to Katzow; U.S. Pat. No. 3,541,013 to Acriss et al.; U.S. Pat. No. 3,609,086 to Modahl et al.; and U.S. Pat. No. 4,055,964 to Swenson et al. All the patents cited utilize absorption cooling theory and rely upon gas or oil as the source of requisite heat. (The techings of the above-noted patents are incorporated herein by reference.)

SUMMARY OF THE INVENTION

The problems outlined above are in large measure solved by the improved method and apparatus in accordance with the present invention. That is to say, the method and apparatus hereof provides a system which is of light weight, compact construction, and serves both as an energy source for heating and cooling systems, and as an inexpensive and efficient means for the disposal of waste oil.

The method and apparatus in accordance with the present invention broadly includes a heat transfer fluid reservoir tank, a burner combustion chamber with a waste oil burner, a chiller unit, a heater unit and associated valves, pipes, pumps and control instrumentation. The waste oil burner generates heat by the combustion of waste oil. The heat is next transferred in a heat transfer fluid to the heat transfer fluid reservoir tank. Heat is thereafter transferred in the heat transfer fluid from the reservoir to either a chiller unit, a heater unit, or combinations thereof.

The chiller unit is preferably in the form of an absorption air conditioning or refrigeration device. Such devices are well known in the prior art, and generally employ a heat source and highly endothermic reactants, such as halide salts in water to from a solution which acts as a heat absorption media. Such air conditioning and refrigeration devices operate on a principle of heat absorption by heat exchange with the environment upon contact with endothermic reaction products.

Typically, the working medium in an absorption air conditioning or refrigeration heating cycle is ammonia and water, wherein ammonia vapor is first extracted from and then absorbed into the ammonia solution. Ammonia has a lower boiling point and a higher vapor pressure than water; in ammonia-based systems, ammonia acts as the refrigerant and the ammonia-water solution as the absorbent.

Another example of a working medium employed in an absorption air conditioning or refrigeration cycle is a solution of water and lithium bromide. Water has a lower boiling temperature and a higher vapor pressure in the gaseous phase for a specified temperature than does a solution of lithium bromide. Water in a lithium bromide solution functions like the ammonia acting as a refrigerant in the ammonia working medium. Theoretically, any substance having a high endothermic affinity for one another and which can be separated by heating may be used in an absorption air conditioning or refrigeration device.

The heater unit are also well known in the prior art and are generally conventional heat exchangers configured to allow heat to be transferred from one fluid to another.

My invention resides not in any one of these features, per se, but rather in the particular combination of all of them herein disclosed and claimed and it is distinguished from the prior art in this particular combination of all of its structures for the functions specified.

There has thus been outlined, rather broadly, the more important features of the invention in order that the detailed description that follows may be better understood, and in order that the present contribution to the art may be better appreciated. There are, of course, additional features of the invention that will be described hereinafter which will form the subject matter of the claims appended hereto. Those skilled in the art will appreciate that the conception, upon which this disclosure is based, may readily be utilized as a basis for the designing of other structures, methods and systems for carrying out several purposes of the present invention. It is important, therefore, that the claims are regarded as including such equivalent constructions insofar as they do not depart from the spirit and scope of the present invention.

Further, the purpose of the foregoing summary is to enable the U.S. Patent and Trademark Office and the public generally and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

OBJECT AND ADVANTAGES

It is therefore an object of the present invention to provide a new and improved air conditioning apparatus which has all the advantages of the prior art and none of the disadvantages.

It is also an object of the present invention to provide a new and improved absorption air conditioning apparatus capable of utilizing waste oil as a fuel for operation. The present invention is also designed to provide a safe and economical method of waste oil disposal in warm regions of the country.

It is another object of the present invention to provide a new and improved air conditioning apparatus which is less expensive to operate than the prior art which uses gas or furnace fuel.

It is a further object of the present invention to provide an air conditioning system which does not require the use of Freon.

Yet a further object of the present invention is to provide a new and improved air conditioning apparatus of durable and reliable construction, with component parts susceptible to simple and economical repair or replacement.

There, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

Other objects and advantages of the present invention will become more readily apparent after considering the following drawings and description.

DETAILED DESCRIPTION OF THE PREFERRED EMBODIMENT

Figure 1:
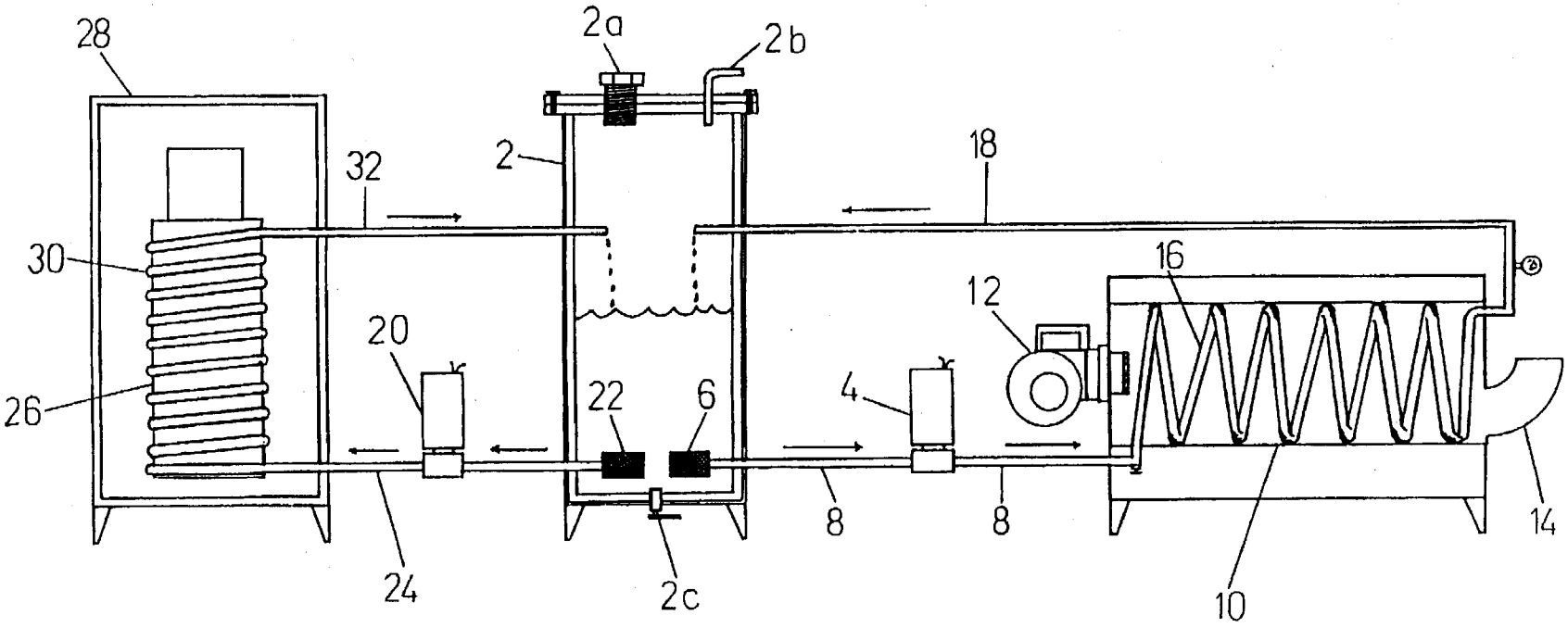
FIG. 1 is a schematic of the apparatus according to the instant invention making use of an open-vented heat exchange system which transfers heat from the waste oil burner combustion chamber to an absorption air conditioner.

Referring now to FIG. 1, a system is disclosed which broadly includes a heat transfer fluid storage tank 2, a combustion chamber 10, a waste oil burner 12 and an absorption air conditioner 28.

Heat transfer fluid is contained in a heat-resistant storage tank 2 possessing an inlet opening 2*a*, an air vent 2*b* and an outlet valve 2*c*.

Heat transfer fluid includes any fluid capable of transferring heat at a high temperature. Heat transfer fluid is a high temperature oil suitable for the transfer of heat under conditions and in accordance with the practice of the present invention, as described and shown herein. The heat transfer fluid is, in the preferred embodiment, a synthetic oil such as Amoco Oil No. 4199.

Storage tank 2, in the preferred embodiment, may be insulated by conventional means to make it heat-resistant. Heat transfer fluid is pumped by a high temperature oil pump 4 through an oil filter 6 and into a length of steel pipe 8 which transfers the fluid into the combustion chamber 10 of a waste oil burner 12.

A waste oil burner 12 is fired into the combustion chamber 10 which possesses an exhaust flue 14 for the escape of fumes. The interior of the burner combustion chamber 10 is lined with a coiled length of hollow tubing 16 containing the synthetic heat transfer fluid from the storage tank 2. The heat transfer fluid in tank 2 is heated to approximately 510–520 degrees Fahrenheit. The tubing 16 containing heat transfer fluid then exits the combustion chamber 10 through a length of steel pipe 18 and returns to the storage tank 2.

Heat transfer fluid in storage tank 2, hot from exposure to the waste oil burner combustion chamber 10, is then pumped by another high-temperature oil pump 20, through an oil filter 22 from the storage tank 2. A length of steel pipe 24 carries the heat transfer fluid to the generator 26 of an absorption air conditioner 28.

Tubing 30 containing heat transfer fluid is wrapped in coil fashion about the exterior surface of the air conditioner generator 26 wherein endothermic reactants are separated by the addition of heat.

The heat transfer fluid is then returned by steel pipe 32 to the storage tank 2 for recycling to the waste oil burner combustion chamber 10.

In the preferred embodiment, conventional electronic and mechanical controls are provided to prevent the system from overheating and to allow the system to be thermostatically controlled.

Figure 2:
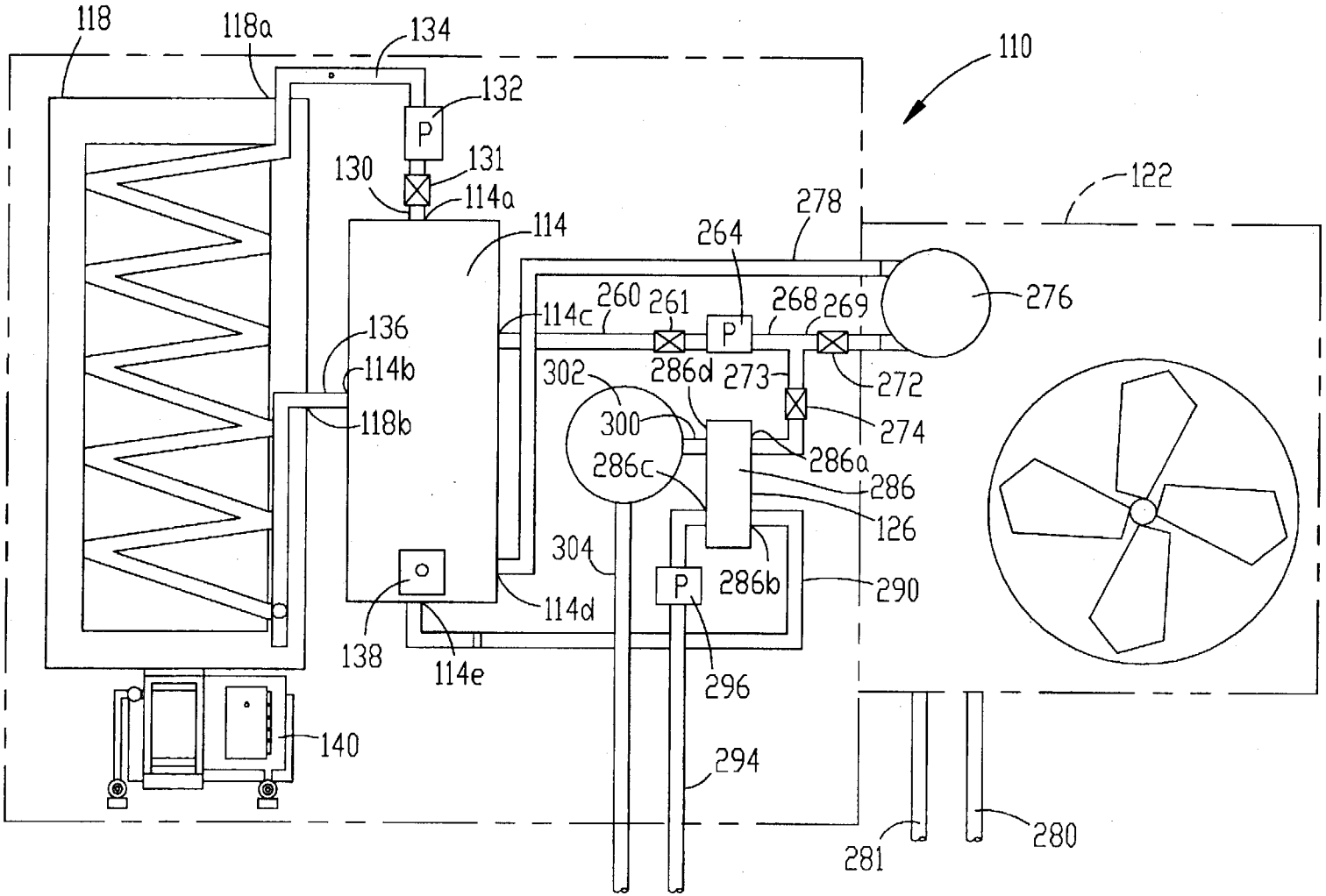
FIG. 2 is a schematic of the apparatus according to the instant invention making use of a closed heat exchange system which transfers heat from the waste oil burner to a heating unit, a chilling unit, or combinations thereof.

An alternative closed system embodiment designated 110 in FIG. 2 permits economical combustion of waste oil for use in generating heat in a form that may be employed in either absorption cooling coils (such as those used for air conditioning and refrigeration systems) or heating coils (such as those used for space heaters), and is made up of only four basic units. Those units include a hot oil reservoir tank 114, a burner combustion chamber 118, and a heat accepting means in the form of chiller unit 122 or a heater unit 126, or combinations thereof.

Referring initially to FIG. 2, hot oil reservoir tank 114 contains heat transfer fluid, which in the preferred embodiment is Amoco Oil No. 4199. Heat transfer fluid is discharged from tank 114 through outlet 114*a* and into line 130 and through valve 131 to the suction side of the high temperature heat transfer pump 132. The fluid is discharged from pump 132 through line 134 to the inlet 118*a* of burner combustion chamber 118. Heat transfer fluid is discharged from the combustion chamber outlet 118*b* through line 136, after which is returned to hot oil reservoir tank 114 through tank inlet 114*b*. In the preferred embodiment, tank 114 is under a slight pressure which is indicated by a pressure gauge 138.

The burner combustion chamber 118 will now be described in detail by reference to FIGS. 3 and 4. Burner combustion chamber 118 includes a waste oil burner 140, an inlet sleeve 142, a fluid coil 144, an outlet flow half sleeve 146, a chamber housing 148, a pair of flow baffles 150, 152, a coil support 154 and a flue 156.

Coil 144 is a continuous pipe wrapped in a coil configuration such that a generally barrel shaped annulus 158 is formed by a plurality of coiled tubes 160 placed in abutting relationship to one another. So configured, the interior surfaces of the coiled tubes 160 combines to form a continuous interior surface 162 and a continuous exterior surface 164. Interior surface 162 defines annulus 158. Coil 144 has a combustion gas outlet 168 and combustion gas inlet 169.

Housing 148 includes a circular inlet flange 170 having an inlet opening therethrough, a closed circular flange 171, and a cylindrical housing wall 172 extending therebetween.

Figures 3, 5:
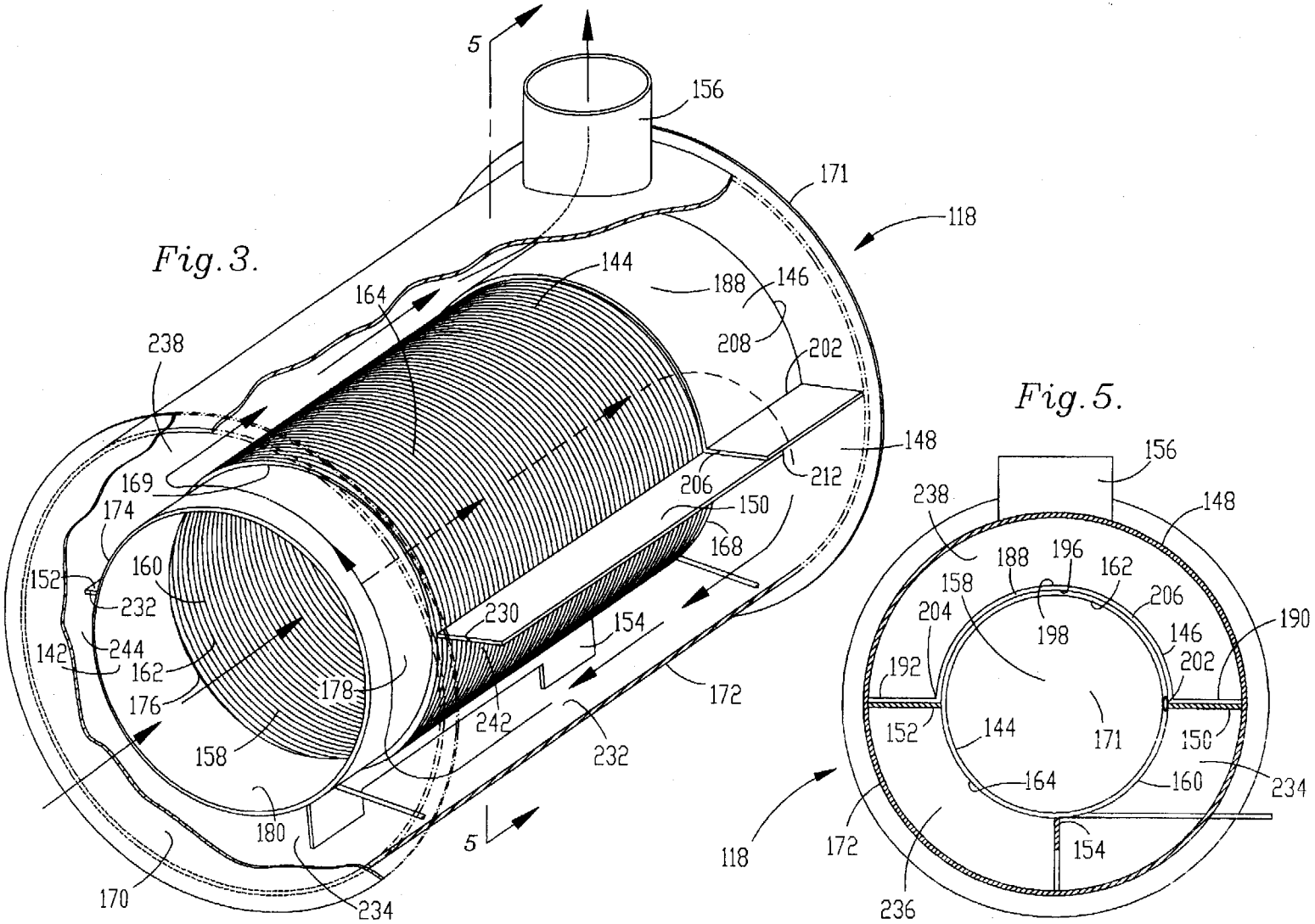
FIG. 3 is a perspective view of the combustion chamber with a portion cut away to show the coils through which heat transfer fluid flows.
FIG. 5 is a sectional view of the combustion chamber taken along line 5—5 of FIG. 3.
Figure 4:
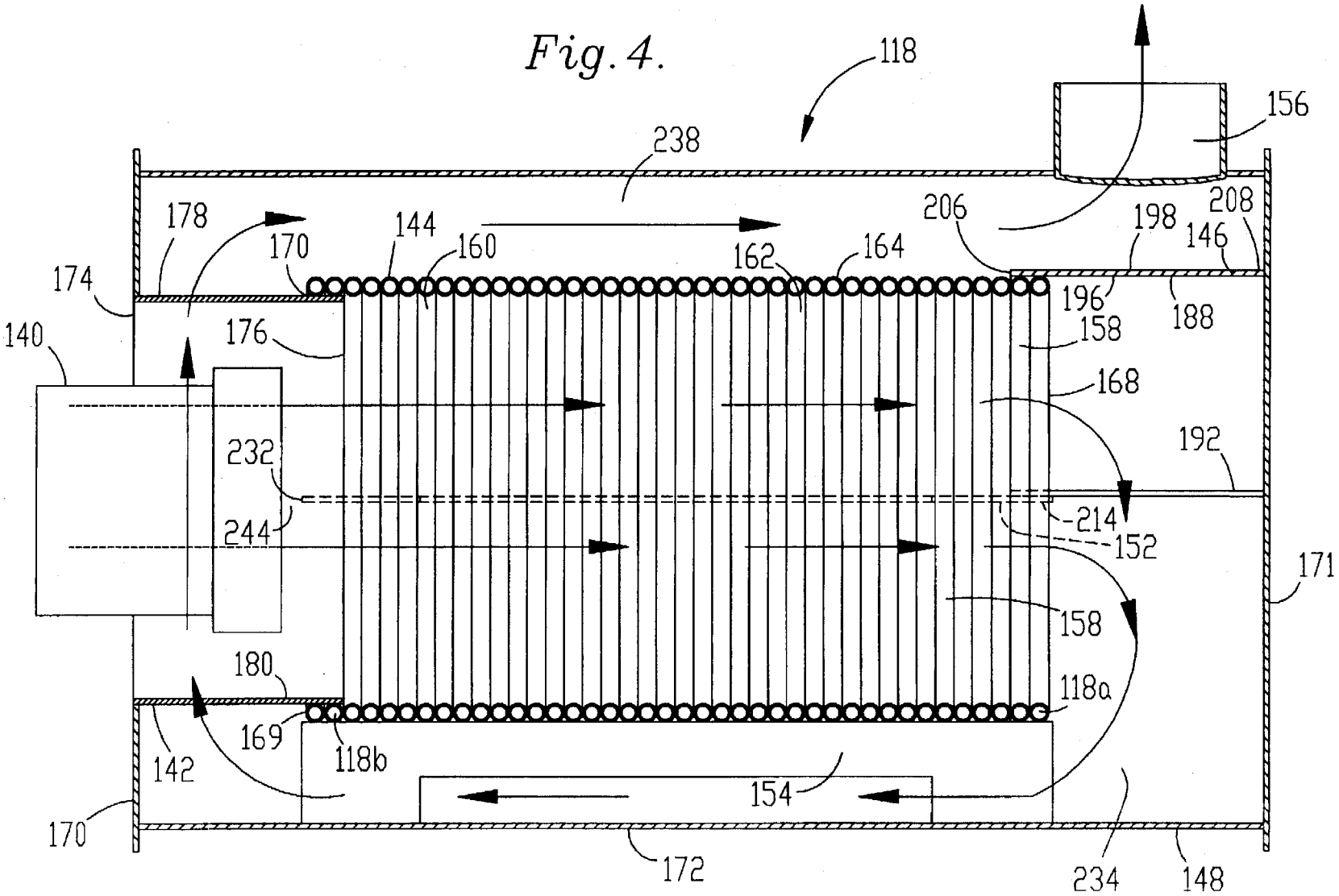
FIG. 4 is a side elevational view of the combustion chamber showing the combustion chamber in cross-section.

Coil 144 is suspended and held in position within housing 148 by means of flow baffles 150, 152 and coil support 154, as shown in FIGS. 3, 4 and 5. More particularly, the majority of the coil 144 weight is supported by coil support 154 and side-to-side movement of coil 144 is prevented by flow baffles 150, 152.

Inlet sleeve 142 includes inlet end 174 and outlet 176, and presents an outer surface 178 and inner surface 180. Sleeve 142 is attached to combustion chamber housing inlet flange 170 so that sleeve inlet 174 aligns with the opening in inlet flange 170, as shown in FIG. 4. Sleeve 142 extends inwardly from inlet flange 170 and is telescopically received a short distance within the coil inlet 169, as shown in FIGS. 3 and 4. The coil inlet 169 overlaps with the outlet 176 of sleeve 142 a sufficient distance and the engagement is sufficiently tight such that a seal is formed between the interior coil surface 162 adjacent the overlapping exterior sleeve surface 178.

Half-sleeve 146 includes an arcuate half-sleeve portion 188 and a pair of flanges 190, 192. Half-sleeve portion 188 extends through a 180 degree curvature and has a radius of curvature which is substantially similar to the curvature of coil exterior surface 164 at outlet 168. Half-sleeve portion 188 presents an interior surface 196 and an exterior surface 198. The arcuate portion of half-sleeve 188 terminates at ends 202, 204 from which flanges 190, 192 extend radially outwardly. Half-sleeve 188 presents proximal and distal edges 206 and 208. Half-sleeve 188 is disposed in relation to coil 144 as shown in FIGS. 3 and 4. More particularly, the half-sleeve interior surface 196 adjacent the half-sleeve proximal edge 206 is in overlapping relationship with the exterior surface 164 adjacent coil outlet 168, such that a seal is formed therebetween. Flanges 190, 192 are also in overlapping relationship with distal ends 212, 214 of flow baffles 150, 152, respectively, as shown in FIGS. 3 and 4. Distal edge 208 of half-sleeve 188 abuts and is in sealed engagement with housing closed flange 171.

Flow baffles 150, 152 and coil support 154 extend radially inwardly from housing cylindrical wall 172. Proximal ends 230, 232 extend to and are flush with coil inlet 169. Baffles 150, 152 and half-sleeve flanges 190, 192, and support flange 154, separate the volume of the combustion chamber which resides between coils 144 and housing wall 228 into a pair of lower flow plenums 234, 236 and upper flow plenum 238. Because proximal baffle ends 230, 232 are flush with coil inlet 169, openings 242, 244 are formed which permit the flow of gases from lower flow plenums 234, 236 to upper flow plenum 238.

Flue 156 is positioned atop housing 148, as shown in FIG. 3, to permit the exhaust of flue gas from housing 148.

The flow of gas through the combustion chamber 118 will now be described by reference to flow arrows appearing in FIGS. 3 and 4. The flame and gases exit waste oil burner 140 are directed by inlet sleeve 142 to the coil annulus 158 and are brought into heat transfer contact with the coil interior surface 162. In the preferred embodiment, the waste oil burner is manufactured by Reznor, Memphis, Tenn., and has a rating of 235000 BTU/hr. Upon exiting the coil outlet 168, the gases are channeled by the half-sleeve 146 into flow plenums 234, 236. The gases pass through flow plenums 234, 236 and are brought into heat transfer contact with the lower half of the exterior surface 164 of coil 144. The gases are next channeled to upper plenum 238 through openings 242, 244. As the gases pass through upper plenum 238, heat is transferred from the gas to the coil 144 through exterior surface 164. The gas is then discharged from the upper plenum 238 through flue 156.

In an alternative embodiment, the combustion chamber 118 as described above may be used to heat water flowing through fluid coil 144. In this alternative embodiment, the structure and operation of combustion chamber 118 is in all other respects identical to that described above. Combustion chamber 118 may be used to heat water for the purpose of transferring heat contained in the heated water from the combustion chamber 118 to any heat accepting means, such as a space heater.

Returning now to a description of other components in the alternative embodiment. Heat transfer fluid exits reservoir tank **114*c* and is transferred to the suction side of a second heat transfer fluid pump 264 through line 260 and valve 261. The heat transfer fluid is discharged from pump 264 into line 268, after which it is directed either through line 269 and valve 272 to chiller unit 122, or through line 273 and valve 274 to heater unit 126**.

Chiller unit 122 may be any air conditioning or refrigeration system, or the like, which employs heat in an absorption type air conditioning or refrigeration system. In the preferred embodiment, the chiller unit 122 is a 5 ton unit manufactured by Robur, Evansville, Ind., which is an absorption chiller. In the chiller unit 122, heat is transferred from the heat transfer fluid to the generator.

The heat transfer fluid is next discharged from the chiller unit 122 into line 278 which returns the heat transfer fluid to reservoir tank inlet **114*d*. Chilled water exits the chiller unit 122 through line 280 where it is supplied to a heat exchanger (not shown) for the removal of heat from a heat source (e.g., a space cooler), after which chilled water is returned to the chiller unit 122 via line 281**.

Line 273 directs the heat transfer fluid to heat exchanger 286 via inlet **286*a*. In the preferred embodiment, heat exchanger 286 is a plate type heat exchanger manufactured by ITT, Schaumburg, Ill., and has a rating of 180,000/hr. Heat transfer fluid exits heat exchanger 286 via outlet 286*b* and is returned through line 290 to reservoir tank inlet 114*e*. A supply of water flows through line 294 and water pump 296 into heat exchanger inlet 286*c* and flows through heat exchanger 286 during which heat is transferred from the heat transfer fluid to the water elevating the water temperature. The water with an elevated temperature exits heat exchanger outlet 286*d* and is supplied via line 300 to an expansion tank 302. Water exiting the expansion tank 302 is supplied via line 304 to a heat exchanger (not shown) which allows the transfer of heat from the water to another medium. Water returning from the heat exchanger is supplied to line 294**.

Certain dimensions and flow parameters will now be described for the preferred embodiment. In the preferred embodiment, cylindrical wall 172 of combustion housing 148 has an internal diameter of about 2 feet and is about 54 inches long. Tube coil 144 has an internal heat transfer area of about 16 square feet and an external heat transfer area of about 17 square feet. The internal diameter of coil 144 annulus 158 is about 20 inches. Coil 144 is constructed from ¾ inches i.d.—schedule 40 iron pipe.

Apparatus 110 is operated either in a chilling mode in which heat transfer fluid is supplied to chiller unit 122 as previously described, or in a heat mode, in which heat transfer fluid is supplied to the heating unit 126.

When apparatus 110 is operated in the chilling mode, heat transfer fluid in tank 114 is maintained at about 510 degrees Fahrenheit, which is also the temperature of the heat transfer fluid that is supplied to the chiller unit 122 through lines 260, 268 and 269. The chiller unit is operated so that the heat transfer fluid returning through line 278 is about 480 degrees Fahrenheit.

When apparatus 110 is operating in the heat mode, heat transfer fluid in tank 114 is maintained at about 220 degrees Fahrenheit, which is also the temperature of the heat transfer fluid that is supplied to heat exchanger 286 through lines 260, 268 and 273. Heat exchange fluid returning to tank 114 from the heat exchanger 286 through line 290 is maintained at about 180 degrees Fahrenheit.

The heat transfer fluid flow, when Amoco Oil No. 4199 is used, is approximately 15–20 gpm. The capacity of the reservoir in the preferred embodiment is 20–23 gallons of heat transfer fluid.

In yet another alternative embodiment, apparatus 110 may be provided with multiple chilling units 122 or multiple heating units 126, or combinations thereof. Apparatus 110 may also be provided with one or more chilling units 122 and without a heating unit 126. Conversely, apparatus 110 may be provided with one or more heating units 126 without a chilling unit 122.

I claim:

1. A heat source system for generating heat from the combustion of waste oil, comprising:

a) a waste oil burner operative to burn waste oil and thereby generate heat;

b) a storage tank containing a heat transfer fluid;

c) a first heat transfer means for transferring at least a portion of said heat generated by said waste oil burner to said heat transfer fluid in said storage tank to increase the heat content thereof;

d) a heat accepting means; and e) second heat transfer means for transferring heat from said heat transfer fluid in said storage tank to said heat accepting means;

f) said heat accepting means being in the form of a chilling unit.

2. A heat source system for generating heat from the combustion of waste oil, comprising:

a) a waste oil burner operative to burn waste oil and thereby generate heat;

b) a storage tank containing a heat transfer fluid;

c) a first heat transfer means for transferring at least a portion of said heat generated by said waste oil burner to said heat transfer fluid in said storage tank to increase the heat content thereof;

d) a heat accepting means; and e) a second heat transfer means for transferring heat from said heat transfer fluid in said storage tank to said heat accepting means;

f) said heat accepting means being in the form of a heating unit.

3. A heat source system for generating heat from the combustion of waste oil, comprising:

a) a waste oil burner operative to burn waste oil and thereby generate heat;

b) a storage tank containing a heat transfer fluid;

c) a first heat transfer means for transferring at least a portion of said heat generated by said waste oil burner to said heat transfer fluid in said storage tank to increase the heat content thereof;

d) a heat accepting means: and e) a second heat transfer means for transferring heat from said heat transfer fluid in said storage tank to said heat accepting means;

f) said heat accepting means being in the form of at least one heating unit and one chilling unit.

4. A heat source system as set forth in claim 1, a) said waste oil burner including a combustion chamber; and b) said first heat transfer means comprising a first pipe connecting the storage tank to a first high temperature fluid pump, c) a second pipe connecting said first high temperature pump to a length of tubing coiled inside the combustion chamber of the waste oil burner such that said tubing will be in the proximity of the waste oil burner flame, wherein the heat transfer fluid is heated, and d) a third pipe connecting said coiled tubing to said storage tank.

5. A system as set forth in claim 1, a) said chilling unit comprising a absorption air conditioning device including a generator;

b) said second heat transfer means comprising a first pipe connecting said storage tank to a second high temperature fluid pump, c) a second pipe connecting said second high temperature fluid pump to said air conditioning device for transferring heat from the heat transfer fluid to the generator, and d) a third pipe connecting the said air conditioning device to said storage tank.

6. A system as set forth in claim 1, a) said first heat transfer means comprising a heat exchanger operable to transfer heat from said heat transfer fluid to a space to be heated;

b) said second heat transfer means comprising a first pipe connecting said storage tank to a second high temperature fluid pump, c) a second pipe connecting said second high temperature fluid pump to a length of tubing coiled around a generator of said heat accepting means for transferring heat from the heat transfer fluid to the generator, and d) a third pipe connecting the coiled tubing around the generator to the storage tank.

7. A method for generating heat, comprising:

a) providing waste oil burner and burning waste oil therein to generate heat;

b) providing a storage tank containing heat transfer fluid;

c) transferring at least a portion of said heat generated by said waste oil burner to said heat transfer fluid in said storage tank;

d) providing a heat accepting means; and e) transferring to said heat accepting means at least a portion of said heat transferred from said waste oil burner to said heat transfer fluid in said storage tank.

8. A method for generating heat as set forth in claim 7, said heat accepting means being in the form of a chilling unit.

9. A method for generating heat at set forth in claim 7, said heat accepting means being in the form of a heating unit.

10. A method for generating heat at set forth in claim 7, said heat accepting means being in the form of at least one chilling unit and at least one heating unit.

11. A method as set forth in claim 8, said chilling unit being in the form of an absorption air conditioning device having a generator.

12. A method as set forth in claim 9, said heating unit being in the form of a heat exchanger operable to transfer heat from said heat transfer fluid to a space to be heated.

* * * * *